US005546071A

United States Patent [19]

Zdunich

[11] Patent Number: 5,546,071

[45] Date of Patent: Aug. 13, 1996

[54] CONCEALED SECURITY SYSTEM

[76] Inventor: Gordon L. Zdunich, 4474 S. 4515 West, West Valley City, Utah 84120

[21] Appl. No.: 398,984

[22] Filed: Mar. 6, 1995

[51] Int. Cl.[6] ..... G08B 13/00

[52] U.S. Cl. ..... 340/541; 340/550; 340/691; 340/693

[58] Field of Search ..... 340/541, 554, 340/691, 693, 556, 531; 348/151, 156, 143, 152, 153, 154, 155

[56] References Cited

U.S. PATENT DOCUMENTS

| | | | |
|---|---|---|---|
| 3,120,579 | 2/1964 | Stewart | 379/39 |
| 3,619,629 | 11/1971 | Mathews | 340/556 |
| 3,710,024 | 1/1973 | Lacey | 340/531 |
| 3,786,502 | 1/1974 | Stendig et al. | 340/521 |
| 3,866,198 | 2/1975 | Cohen | 340/522 |
| 3,937,891 | 2/1976 | Roeder | 379/40 |
| 4,027,103 | 5/1977 | Roeder | 379/40 |
| 4,420,238 | 12/1983 | Felix | 348/151 |
| 4,437,089 | 3/1984 | Achard | 340/541 |
| 4,638,293 | 1/1987 | Min | 340/693 |
| 4,742,336 | 5/1988 | Hall et al. | 340/539 |
| 4,800,361 | 1/1989 | Greif | 340/541 |
| 4,843,461 | 6/1989 | Tatsumi et al. | 348/156 |
| 4,881,135 | 11/1989 | Heilweil | 348/151 |
| 4,963,962 | 10/1990 | Kruegle et al. | 348/151 |
| 4,982,281 | 1/1991 | Gutierrez | 348/151 |
| 5,019,802 | 5/1991 | Brittain et al. | 340/522 |
| 5,155,474 | 10/1992 | Park et al. | 340/693 |
| 5,164,979 | 11/1992 | Choi | 340/533 |
| 5,334,974 | 8/1994 | Simms et al. | 340/988 |
| 5,379,029 | 1/1995 | Kuantang et al. | 340/693 |

*Primary Examiner*—John K. Peng
*Assistant Examiner*—Benjamin C. Lee
*Attorney, Agent, or Firm*—Thorpe North & Western

[57] ABSTRACT

A concealed security system is disclosed including a security sensor which is disposed in conventional appliances, such as televisions, video cassette recorders, telephones and the like. The security sensors are disposed so as to blend with the components of the appliance and thereby be generally unnoticeable to intruders. In accordance with one aspect of the invention, the normal functioning of the appliance is modifiable so as to disguise an indication signal which indicates to the user that the sensor is activated.

19 Claims, 4 Drawing Sheets

CONCEALED SECURITY SYSTEM

BACKGROUND OF THE INVENTION

The present invention relates to a concealed security system, and, in particular, to a method for effectively and inexpensively concealing security sensors so as to increase the numbers of burglars who are caught in the act of burglarizing a house, business or other property.

The use of burglar alarms and other methods for preventing loss caused by theft is extremely is well known. Currently there exists hundreds, if not thousands, of different devices and systems which are used to prevent unauthorized entry or to terminate unauthorized presence once unauthorized entry has occurred. The goals of such devices are to decrease theft of property and the likelihood that authorized occupants of the building may be harmed by an intruder.

In one such system a plurality of switches are disposed so that a switch is adjacent each door, window, or other likely point of unauthorized entry. When the door or window is opened, a connection is broken or the switch is moved. In response to the break in connection, etc., the switch sends a signal to a central processing unit indicating that the door or window which it is adjacent to has been opened. The central processing unit, in turn, undergoes a delay function which allows adequate time for a person to turn off the system by entering a code to the central processing unit. If the code is not entered within the delay period, the central processing unit activates an alarm. This may either be a loud audible alarm within the protected premises, or a silent call to a security company or law enforcement agency indicating that an unauthorized entry has been made.

In another type of system, a plurality of sensors are placed within a house or building. The sensors monitor either motion within the room (motion detectors) or sudden changes in heat (heat sensors) as would occur when a person enters a room. In order to monitor an entire room or hallway, the sensors are typically placed in an upper corner of the room or hallway adjacent to the ceiling. In order to indicate to those authorized to be in the building that the system is activated, the heat sensor or motion detector will typically have a small flashing light. Thus, a person making an authorized entry will be reminded that the system needs to be deactivated so that a false alarm does not occur.

Those skilled in the art will recognize that there are many other systems available, and many which combine the various elements of the two discussed above. Such systems, however, are generally ineffective at assisting in the capture of a burglar or other person making an unauthorized entry. This is primarily because the sensing portions of the system are visible and warn the intruder that an alarm system is in place. For example, many switches are visible from outside the window. If the burglar is simply looking for any building to burglarize, he or she will simply move on. If the building with the switches is the intended target, the burglar may circumvent the system by, for example, breaking the window, rather than opening it, or by providing a device which prevents the switch from indicating that the window has been opened.

The motion detectors and heat sensors also fail to assist greatly in the capture of the intruder. Typically the intruder will notice the activated motion detector or heat sensor before the alarm has been activated. The burglar may then either leave immediately, or grab a few valuables and run.

Either way, by the time the police arrive, the burglar is far from the premises.

To overcome these concerns, complex systems have been developed to catch the burglar in the act. For example, pressure sensors may be placed in the floor so that any movement thereon is detected. In the alternative, lasers may be positioned within a room so that the a person entering the room will break the continuity of the laser's beam, thereby indicating an intruder. While such systems are extremely effective, they are also expensive and generally limited in use to museums and the homes of the very wealthy.

Thus, there is a need for a simple, inexpensive method for concealing burglar detection devices to assist in the capture of burglars and other intruders.

SUMMARY OF THE INVENTION

It is an object of the present invention to provide a method for concealing burglar detection devices so as to increase the number of burglars and other intruders who are captured.

It is another object of the invention to provide system including such a method which is easy to use.

It is another object of the invention to provide such a system which is inexpensive.

It is yet another object of the invention to provide a system in which the activated and deactivated states are easily recognizable to those using the system, while not being recognizable to intruders.

The above and other objects of the invention are realized in specific illustrated embodiments of a concealed security system including an intrusion detector, such as a heat sensor or a motion detector concealed within the housing of a household appliance, such as a video cassette recorder, a television, a telephone or other device.

In accordance with one aspect of the invention, the intrusion detector is connected to the clock of a video cassette recorder, and activation of the detector causes the clock of the video cassette recorder to indicate that the detector is activated in such a manner as to be generally unnoticeable to an intruder. For example, when the detector is activated, the clock may continue to blink, as is common when the time has not been set, but will continue to keep time. By looking at the video cassette recorder, the user may easily tell that the system is activated. However, this will not be apparent to a burglar or other intruder.

In accordance with another aspect of the invention, the detector may be placed in a telephone or a telephone with an answering machine or some other recording device. Upon detection of an unauthorized entry, the telephone can automatically dial a security company or the police, and deliver a prerecorded massage that an unauthorized entry has occurred. By positioning several telephones having a detector at various places within a house or business, the entire house or business could be monitored to warn of a person making an unauthorized entry.

In accordance with yet another aspect of the present invention, the detector may be placed within an cellular telephone mounted in a car, so as to automatically call the police if the car is broken into or stolen.

In accordance with still another aspect of the present invention, the appliance into which the detector is placed may have an electronic means for recording the number of unauthorized entries, as well as their time and date.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
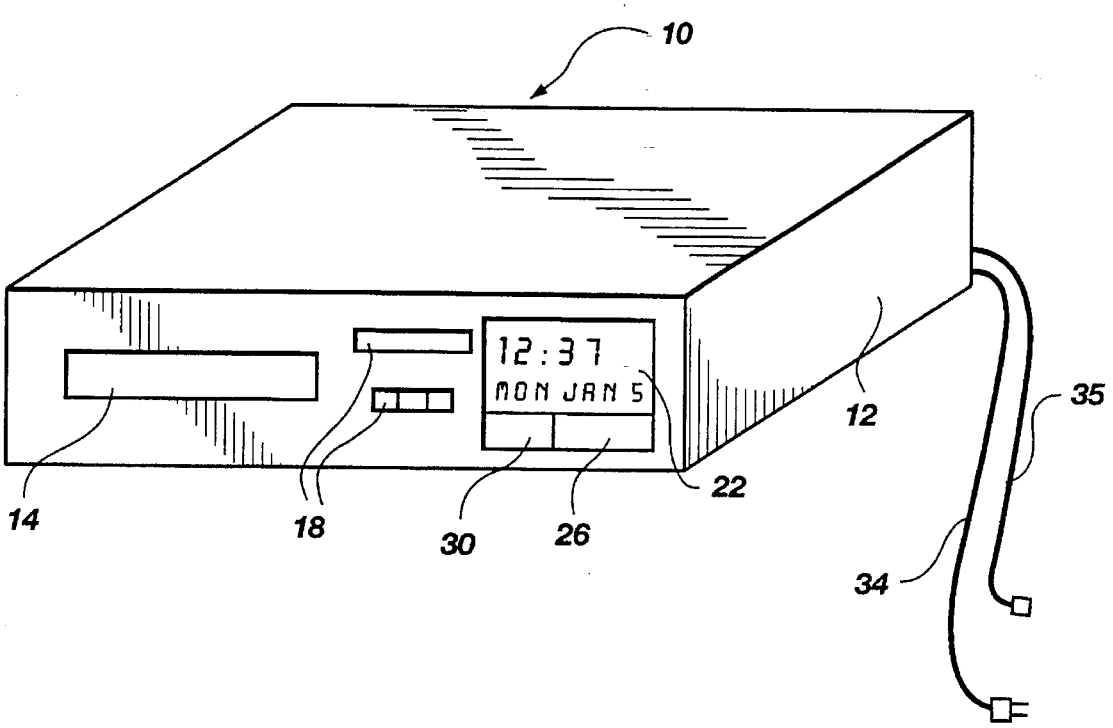
FIG. 1 shows a perspective view of a concealed security system, including a video cassette recorder with a motion sensor disposed therein and a connection line for connecting the motion sensor to a central processing unit.

Reference will now be made to the drawings in which the various elements of the present invention will be given numeral designations and in which the invention will be discussed so as to enable one skilled in the art to make and use the invention. Referring to FIG. 1, there is shown a perspective view of a video cassette recorder, generally indicated at 10, comprising a portion of a concealed security system. The video cassette recorder 10 has a housing 12 with a conventional slot 14 for receiving a video cassette. Disposed on the outside of the housing 12 are a plurality of control buttons 18 which are used to control the playing of the video cassette once it is placed in the slot 14. The control buttons 18 also control a clock 22 and, a security sensor 26 which is positioned below the clock.

The security sensor 26 may be a heat sensor, a motion detector or any other device which can remotely detect the entry of a person into a monitored area. The security sensor 26 is designed so that the surface of the sensor visible outside the housing 12 resembles either the surface of the clock 22 or a sensor 30 for receiving signals from a remote control (not shown). This could be accomplished fairly easily by covering the clock 22, the intrusion detector 26 and the remote control sensor 30 with a single piece of tinted glass or plastic.

Power is supplied to the video cassette recorder 10, and its relative parts, by a conventional power supply line 34. The security sensor 26 communicates with a conventional central processing unit (not shown) through a communication line 38. This line could either be a line which can be plugged into a telephone line, or could be the conventional wiring which is used with other traditional security systems. Alternatively, a transmitter could be placed in the video cassette recorder 10 for transmitting an indication signal to the central processing unit without the need for any wires.

In a preferred embodiment, the clock 22 is interactive with the security sensor 26 so that the clock may indicate to a user when the system has been activated. For example, it is common for some brands of video cassette recorders to repeatedly flash 12:00 if the clock has not been set. If the clock has been set, the time is held generally constant, i.e. nonflashing. In such a make of a video cassette recorder, an activated system could be represented by a flashing time signal. In the alternative, the clock 22 of the video cassette recorder 10 could be programmed to blink when the security sensor 26 has been deactivated. By allowing the user to program what signal is given to indicate that the system is activated or deactivated, the likelihood that a burglar will know that the video cassette recorder is also a security system is reduced. Additionally, even if the burglar determines that the video cassette recorder 10 is part of such a system, it will be nearly impossible to determine if the system is activated or not. While the numerous types of circuitry which could be used to enable the clock to be programmed in such a manner are not disclosed, such circuitry will be apparent to those skilled in the art in light of the discussion provided herein and in light of skills generally had in the art.

Placing the security sensor 26 in a video cassette recorder 10 or in a television, not shown, provides several advantages. First, the detector 26 is not easily seen by a burglar or other intruder. Unlike systems where the motion detector or heat sensor is openly visible, the intruder monitored by the detector 26 will often be unaware of the presence of a security system until well after the police have been notified. Second, televisions and video cassette recorders 10 are often placed in such a position that they may be seen from nearly every other part of the room. Thus, the security sensor 26 will typically have a broad view of the room, obviating the need to place the detector in an upper corner of the room where it is clearly visible. Additionally, because video cassette recorders and televisions are often the objects of property theft, a burglar will frequently approach the television and video cassette recorder to determine whether they are worth stealing. As he or she does so, the police are being notified of an unauthorized entry.

Figure 2:
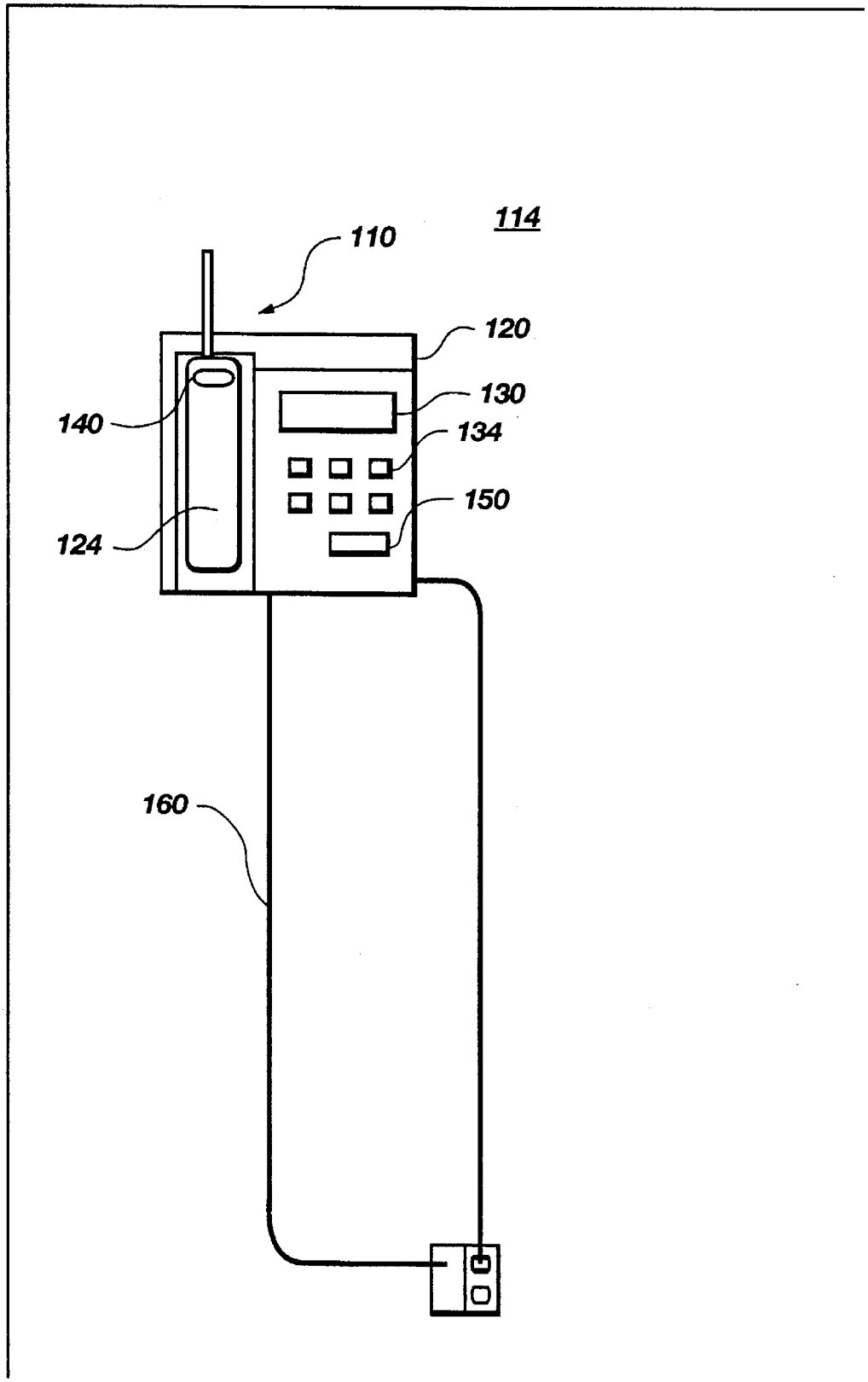
FIG. 2 shows a perspective view of another embodiment of a concealed security system including a cordless telephone and a built-in answering machine.

Referring now to FIG. 2, there is shown an alternate embodiment of the present invention. A telephone 110 is mounted so as to rest against a wall 114. In a preferred embodiment, the telephone 110 will include a base unit 120 which remains attached to the wall 114 and a cordless telephone 124 which may be removed from the base unit. The base unit 120 will preferentially have a telephone answering machine 130 with numerous buttons 134 to control its various functions. Such cordless 124 telephones and answering machines 130 are widely available and are well known to those skilled in the art.

The cordless telephone 124 has a first security sensor 140 contained thereon. The security sensor 140 can be mounted on the back of the telephone, as is shown in FIG. 2, or may be positioned on the front of the telephone adjacent a number dialing pad (not shown) so that the sensor is less noticeable. A second security sensor 150 is also placed on the base unit 120 so that it will blend in with the answering machine 130. If the answering machine 130 has a digital display, the second security sensor 150 will typically be positioned adjacent the display so that the face of the digital display and the face of the security sensor blend together.

While positioning the security sensors 140 and 150 could be done in any telephone, the embodiment described above has several advantages. First, by placing the security sensors 140 and 150 in a telephone with an answering machine 130, the indication signal which warns the user that the system has been activated can be concealed from those who are not authorized to use the system. For example, answering machines typically have either a flashing light or digital display which tell the user that there are messages on the machine.

By integrating the one or more security sensors 140 and 150 into the answering machine 130, the user can program the answering machine to give a different signal when the security sensors 140 and 150 have been activated than when a message has simply been received. For example, if a flashing light indicates the number of messages, the first flash could be longer than the others, or the timing between flashes could be changed. If a digital counter is used, the numeral indicating the number of calls received could flash if the sensor is deactivated and remain constant when the system is activated. Preferentially, the method of indicating an activated and deactivated system will be chosen by the user. Thus, even if the burglar knows that the telephone 110 includes intrusion sensors 140 and 150, he or she will not know whether the system has been activated or not.

As will be appreciated by those skilled in the art, an additional advantage of having an answering machine 130 connected to the security sensors 140 and 150 is that answering machine can take the place of a conventional central processing unit. If one of the security sensors 140 or 150 are activated, the answering machine 130 will wait a predetermined amount of time and then automatically call the police or a security company and deliver a prerecorded message that an unauthorized entry has been made at a certain address. Systems which automatically call the police or a security company are well known, and examples of such systems are contained in U.S. Pat. Nos. 3,710,024; 3,786,502; 3,866,198; 3,937,891; 4,027,103; 4,742,336; 5,019,802; and 5,164,979, and are expressly incorporated herein. By having the answering machine deliver a prerecorded message, the time necessary to track the telephone call is eliminated. Additionally, the telephone can be used at different locations, unlike a conventional security system. The user need only record a new address before activating the security sensors 140 and 150.

An additional advantage of the present embodiment is that the cordless telephone handset 124 can be positioned anywhere in the house. The handset 124 of a cordless telephone already has the ability to communicate with the base unit 120 without connecting wires. Thus, in a small apartment, the base unit 120 and the handset 124 can effectively cover the majority of the apartment to ensure that no intrusion has taken place. Therefore, there is no need for additional sensors or wires being strung to various locations. When an intruder enters, one of the sensors 140 and 150 will detect the entry and the answering machine 130 will use the telephone line 160 to contact the police or a security company. Thus, the apartment is provided with a security system at only a slightly greater cost than would be incurred for simply purchasing a cordless telephone.

As will be appreciated by those skilled in the art, the same principles could also be applied to portable telephone, and in particular to telephones which are mounted in automobiles. The cellular telephone would typically include a sensor similar to that discussed above. The user could prerecord the location of the automobile when parking. If the automobile were broken into. The message taped would give the address of the automobile. Additionally, many devices are available which allow a person or object to be tracked from remote distances. See e.g. U.S. Pat. No. 5,115,223, which is expressly incorporated herein. Such a device may be included and activated when the sensor indicates an unauthorized entry, thereby assisting the police in tracking the automobile.

Figure 2A:
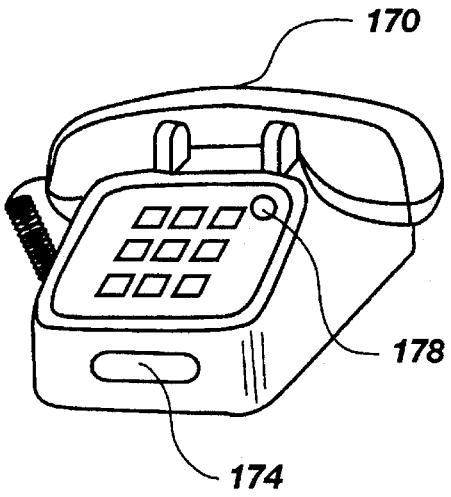
FIGS. 2A and 2B show perspective views of other embodiments of the concealed security system of the present invention in which a sensor is placed in a conventional telephone.

An additional us of such a phone system is that a hotel could use the security sensors to monitor their housekeeping staff and to determine if a person has made an unauthorized entry into a guest's room. An example of a traditional telephone, such as those used in hotels and motels, is shown in FIG. 2A. The telephone 170 includes a sensor 174 disposed therein, and a light used to indicate to the user when the sensor is activated. As will be appreciated by those skilled in the art, the telephone 170 could be made to give one ring each time the sensor 174 detects an entry, so as to indicate to a user that the telephone is activated, while appearing to a person making an unauthorized entry simply to be a wrong number.

If it is known that the occupants of a particular room are out, the time frame during which the security sensors are activated (or deactivated if employees are given the activation/deactivation number) may be used to determine if employees are taking unauthorized-breaks, or spending too much time straightening a room.

The sensor may also be used to determine unauthorized entry. If a sensor shows that a person is in the room, and either the employees are provided with a deactivation code, or are not scheduled to be cleaning the particular room at that time, the hotel or motel may dispatch security personnel to observe the room and determine that the guests belongings are not being stolen.

Figure 2B:
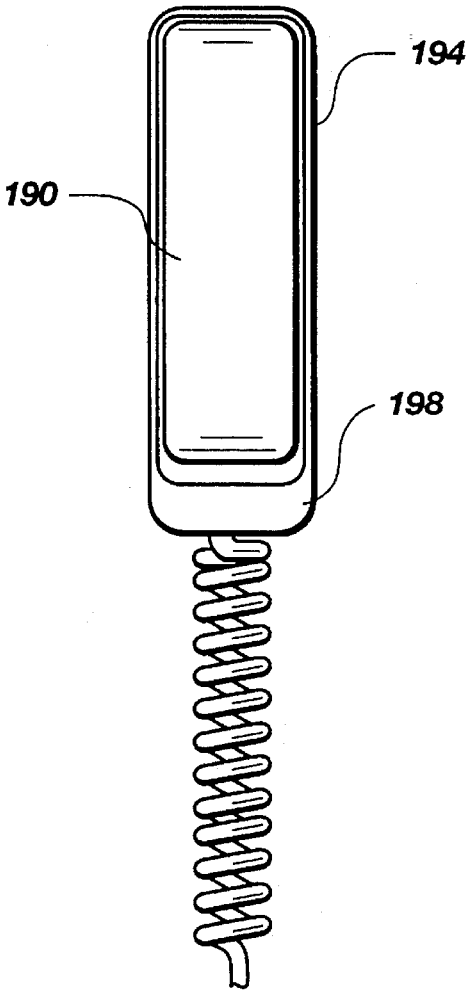

Referring now to FIG. 2B, there is shown another embodiment of the present invention. The embodiment includes a telephone 190 having a motion detector or other sensor 194. While the telephone 190 may also have an indicator light 198 for indicating whether the sensor 194 is activated, such is not the preferred embodiment as it will tend to indicate to an intruder that an alarm system is present. Rather, a preferred embodiment will have a disguised indicator, such a modified ring to indicate when the sensor 194 has been activated, so that an intruder will be unaware of the system. Such a simple device will be particularly beneficial for those, such as college student, and others living on tight incomes who are unable to afford more extravagant systems. The telephone 190 can simply be positioned toward the most likely point of entry.

Figure 3:
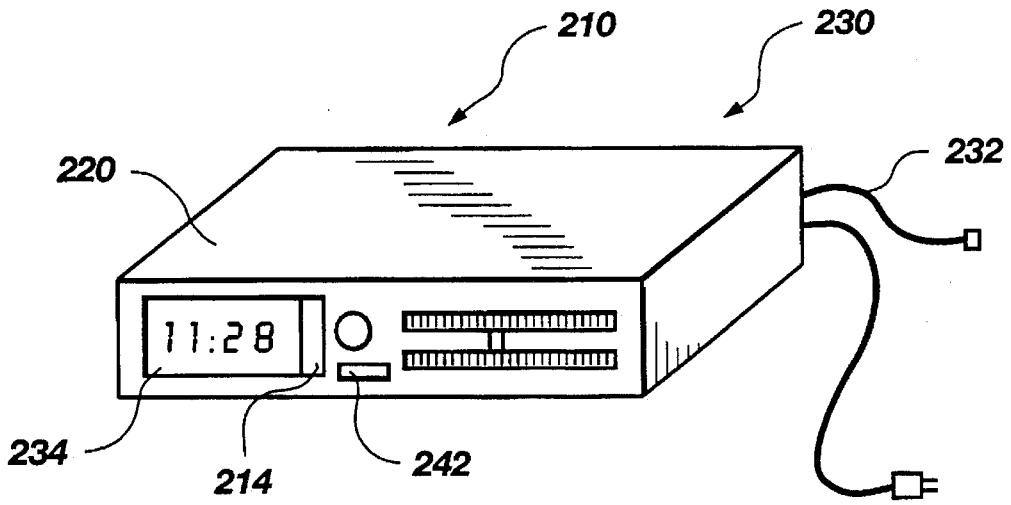
FIG. 3 shows a perspective view of yet another embodiment of the present invention, wherein a portable appliance includes a detector and a display for indicating the number of unauthorized entries and their times.

Referring now to FIG. 3, there is shown yet another embodiment of the present invention. The concealed security system, generally indicated at 210, includes a security sensor 214 which is positioned in the housing 220 of a conventional looking clock/radio 230. As with the other embodiments, the sensor 214 is positioned near a digital clock 234 or other surface which conceals the sensor so that it is not apparent when glancing at the clock. The control buttons 242 which are used to program the clock 234 are also used to activate and deactivate the security sensor 2141.

In distinction to the embodiments discussed with respect to FIGS. 1 and 2, the security sensor 214 of the clock/radio 230 is typically not connected to a central processing unit. However, a telephone or other connection 232 could be provided when desired by the user.

The clock/radio 230, records the time of each instance when the security sensor 214 detects an intruder and was not deactivated within a predetermined time frame, such as 15 seconds. Thus, when the user returns, he or she may determine the exact time at which someone made an unauthorized entry. By pressing the proper sequence of control buttons, the system can be deactivated. The number of entries since the system was activated would then be displayed, followed by their times. By recording when the entry was made, law enforcement officials are better able to prove the case of theft, and rule out suspects with legitimate alibis.

The embodiment described is particularly useful in situations where the emission of an alarm is not desirable, or effective. For example, one common concern of travellers is that hotels and motels are generally given some liability protection for items taken from the rooms of their guests. If the guest can show, however, that it was an employee of the hotel or motel that actually took his or her valuables, the facility may compensate the individual rather than suffering the loss of good will with its customers and the ensuing damage to its reputation. If the guest can show that only one entry was made into the apartment while he or she was gone, he or she may provide fairly conclusive evidence to the hotel or motel that the lost articles were taken by the employee of the hotel or motel who cleaned the room. To catch dishonest employees, hotels and motels may install such devices on their own accord.

Figure 4:
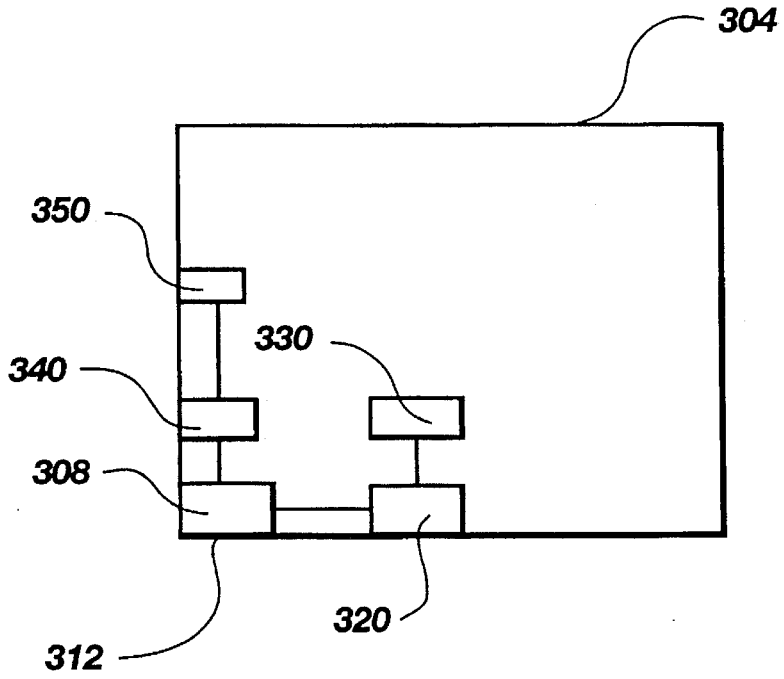
FIG. 4 shows a schematic of still another embodiment of the present invention.

Referring now to FIG. 4, there is shown a schematic of the present invention. A large box 304 is provided to represent the outer wall of an appliance housing which is used to hold and hide the sensor. This housing 304 may be a video cassette recorder, a television, a clock, a radio, a lamp, oven, refrigerator, dishwasher, clothes washer, dryer or virtually any other household appliance which can be used to conceal a security sensor 308. The active face 312 of the sensor, i.e., the surface which detects the presence of a person within the monitored area, is positioned to face outwardly from the housing 304.

The security sensor 308 is connected to a control panel 320 which can also be used to operate other structures (represented by box 330) which control functions of the appliance, such as the light of a lamp, the time features of a clock, etc. The security sensor 308 is also connected to an processing unit 340. This may be accomplished by having a line, such as the telephone line 38 of FIG. 1 which connects the sensor to a conventional central processing unit, or the processing unit may be inside the machine, as in the answering machine 130 of FIG. 2 and the clock 234 of FIG. 3.

The central processing unit 340 will, in turn, activate an alarm mechanism 350. This may be a conventional audible alarm, or a call to a police agency or security company as discussed with respect to FIGS. 1 and 2, or a recording device which will display the time and date of each unauthorized entry. Of course, processing unit 340 can be programmed to provide a predetermined delay to enable a user of the appliance to deactivate the sensor Those skilled in the art will recognize that there are numerous different methods in which the security sensors discussed could be connected into conventional electronics of the various household appliances, and appliances which are yet to be invented. The exact method of integrating the security sensors will depend on the particular brand and type of appliance with which it is to be used and will be apparent to those skilled in the art.

Thus, there is disclosed a concealed security system for increasing the likelihood of catching burglars and other intruders in the act. The system includes concealing a security sensor within a household appliance, such as a television, a video cassette recorder, a telephone, a clock, a stereo, etc., so that it will not be easily recognized by burglars and other intruders. Preferably, the security sensor will be controlled with a common control panel with the remaining functions of the appliance and will have a disguised indication that the sensor has been activated. Those skilled in the art will recognize numerous modifications which may be made to the present invention without departing from the scope or spirit of the invention. The appended claims are intended to cover such modifications.

I claim:

1. A concealed security system comprising:

a household appliance selected from the group consisting of a television, a video cassette recorder, and a clock, the appliance including a housing with an outer wall and a control panel forming a portion of the outer wall, the control panel being in communication with a processing means;

security sensing means for monitoring an area and detecting the presence of a person within the area, the security sensing means being disposed in the outer wall of the housing so as to have an appearance indistinguishable from the outer wall, and electronically connected to the control panel, said sensing means being responsive to a control signal generated by the control panel, for activating and deactivating the security sensing means; and communication means disposed at least partially within the household appliance for communicating with a remote location so as to indicate when the security sensing means detects the presence of a person within the area, the communication means comprising a telephone line.

2. The concealed security system of claim 1, wherein the appliance comprises a video cassette recorder having a digital clock disposed in the housing thereof, and wherein the security sensing means is disposed adjacent to the digital clock.

3. The concealed security system of claim 2, wherein the video cassette recorder comprises a common control panel for controlling the clock and the security sensing means.

4. The concealed security system of claim 3, wherein the clock comprises means for indicating whether the security sensing means is activated.

5. The concealed security system of claim 1, wherein the appliance comprises a video cassette recorder having a remote control sensor disposed in the housing thereof, and wherein the security sensing means is disposed adjacent to the remote control sensor.

6. The concealed security system of claim 5, wherein the video cassette recorder comprises a control panel for activating the video cassette recorder, and for activating and deactivating the security sensor.

7. The concealed security system of claim 1, wherein the appliance comprises a clock, and wherein the security sensing means is disposed adjacent to the clock.

8. The concealed security system of claim 7, wherein the appliance further comprises a recordation means for recording each time the security sensing means indicates the presence of a person within the area, and a display means for conveying each recorded time to a user of the concealed security system.

9. A method for monitoring an area for the presence of persons without indicating that the area is being monitored, the method comprising:

(a) providing a sensor for indicating the presence of a person within the area to be monitored;

(b) positioning the sensor at an outer wall of a household appliance selected from the group consisting of a television, a video cassette recorder, a clock, a lamp, oven, refrigerator, dishwasher, clothes washer, and a dryer so that the sensor may not be readily identified by those in the area to be monitored;

(c) activating the sensor so as to monitor the area; and (d) providing a communication means disposed in the household appliance for contacting a remote location and indicating when the presences of a person within the area to be monitored is detected, the communications means comprising a telephone line.

10. The method according to claim 9, wherein the method further comprises providing a processing unit and a deactivation means in communication with sensor, and programming the processing unit to provide a predetermined delay to enable a user of the appliance to deactivate the sensor before said indicating occurs.

11. The method according to claim 10, wherein the method further comprises causing the processor to produce an alarm signal if the sensor is not deactivated within the predetermined delay, and wherein the alarm signal is conveyed to a remote location by said telephone line.

12. The method according to claim 9, wherein the sensor has controls, wherein the appliance has a control panel for controlling operations of the appliance, and wherein providing a deactivating means comprises integrating the controls of the sensor with the control panel.

13. The method according to claim 9, wherein the appliance comprises a control panel and wherein step (b) comprises, more specifically, positioning the sensor adjacent to the control panel so that the sensor is indistinguishable from the control panel.

14. A concealed security system comprising:

a telephone including a housing with an outer wall and a control panel forming a portion of the outer wall, the control panel being in communication with a processing means;

security sensing means for monitoring an area and detecting the presence of a person within the area, the security sensing means being disposed in the outer wall of the housing so as to have an appearance indistinguishable from the outer wall, and electronically connected to the control panel, said sensing means being responsive to a control signal generated by the control panel, for activating and deactivating the security sensing means, the security sensing means comprising a motion detector means for detecting movement within the area, wherein the telephone comprises a cordless telephone handset, and a base unit, and wherein said motion detector means is disposed within the cordless handset.

15. The concealed security system of claim 14, wherein the telephone further comprises an answering machine, and wherein the answering machine comprises a means for conveying a recorded message via a phone line responsive to an indication from the security sensing means that a person is in the area.

16. The concealed security system of claim 15, wherein the answering machine comprises an indication signal means for indicating whether messages are recorded on the answering machine, and wherein the indication signal means comprises means for modifying the indication signal means to indicate whether the security sensing means is activated.

17. A concealed security system comprising:

a telephone including a housing with an outer wall and a control panel forming a portion of the outer wall, the control panel being in communication with a processing means;

security sensing means for monitoring an area and detecting the presence of a person within the area, the security sensing means being disposed in the outer wall of the housing so as to have an appearance indistinguishable from the outer wall, and electronically connected to the control panel, said sensing means being responsive to a control signal generated by the control panel, for activating and deactivating the security sensing means, the security sensing means comprising a motion detector means for detecting movement within the area, wherein the telephone comprises a cordless telephone handset, and a base unit, and wherein said motion detector means is disposed within the cordless handset; and wherein the telephone further comprises an answering machine, and wherein the answering machine comprises a means for conveying a recorded message via a phone line responsive to an indication from the security sensing means that a person is in the area.

18. The concealed security system of claim 17, wherein the answering machine comprises an indication signal means for indicating whether messages are recorded on the answering machine, and wherein the indication signal means comprises means for modifying the indication signal means to indicate whether the security sensing means is activated.

19. A concealed security system comprising:

a household appliance including a housing with an outer wall and a control panel forming a portion of the outer wall, the control panel being in communication with a processing means, the appliance comprising a television having a remote control sensor disposed in the housing thereof;

security sensing means for monitoring an area and detecting the presence of a person within the area, the security sensing means being disposed in the outer wall of the housing so as to have an appearance indistinguishable from the outer wall, and electronically connected to the control panel, said sensing means being responsive to a control signal generated by the control panel, for activating and deactivating the security sensing means; and communication means disposed at least partially within the housing of the television for communicating with a remote location so as to indicate when the security sensing means detects the presence of a person within the area.

* * * * *